US010602821B2

(12) United States Patent
Young et al.

(10) Patent No.: US 10,602,821 B2
(45) Date of Patent: Mar. 31, 2020

(54) CARRY-ALL BAG WITH FIXED INSULATED AND NON-INSULATED COMPARTMENTS

(71) Applicants: Ta'Loria Da'Shea Young, Palacios, TX (US); Eunice Damaris Martinez-Gonzalez, Palacios, TX (US)

(72) Inventors: Ta'Loria Da'Shea Young, Palacios, TX (US); Eunice Damaris Martinez-Gonzalez, Palacios, TX (US)

( * ) Notice: Subject to any disclaimer, the term of this patent is extended or adjusted under 35 U.S.C. 154(b) by 31 days.

(21) Appl. No.: 15/910,841

(22) Filed: Mar. 2, 2018

(65) Prior Publication Data

US 2018/0279733 A1 Oct. 4, 2018

Related U.S. Application Data

(60) Provisional application No. 62/480,034, filed on Mar. 31, 2017.

(51) Int. Cl.

| | |
|---|---|
| ***A45C 13/02*** | (2006.01) |
| ***A45C 3/06*** | (2006.01) |
| ***A45C 1/02*** | (2006.01) |
| ***A45C 5/00*** | (2006.01) |
| *A45C 13/10* | (2006.01) |
| *A45C 13/22* | (2006.01) |

(52) U.S. Cl.
CPC ..... *A45C 13/02* (2013.01); *A45C 1/024* (2013.01); *A45C 3/06* (2013.01); *A45C 5/00* (2013.01); *A45C 13/103* (2013.01); *A45C 2013/223* (2013.01); *A45C 2200/20* (2013.01)

(58) Field of Classification Search
CPC ..... A45C 13/02; A45C 1/024; A45C 3/06; A45C 5/00; A45C 13/103; A45C 2013/223; A45C 2200/20
USPC ..... 150/107, 100; 383/110
See application file for complete search history.

(56) References Cited

U.S. PATENT DOCUMENTS

| | | | | |
|---|---|---|---|---|
| 2,005,791 A * | 6/1935 | Kruse | ..... | A45C 3/00 206/231 |
| 2,130,502 A * | 9/1938 | Lindemann | ..... | A45C 3/06 150/117 |
| 2,463,993 A * | 3/1949 | Meyers | ..... | A45C 3/06 150/113 |

(Continued)

*Primary Examiner* — Sue A Weaver
(74) *Attorney, Agent, or Firm* — Pharar Patents & Intellectual Property; Andrew A. Pharar

(57) ABSTRACT

The present invention is directed to a soft-sided carry-all bag containing fixed insulated and non-insulated compartments for extensive storage of various items needed for everyday use including, among other things, food, footwear, laptop computers, cellular phones, books and notebooks, writing or eating utensils, water and drinks bottles, eyeglasses, coins, wallets, credit cards, cosmetics, toiletries, and clothing. The bag is meant to provide an individual with a means for consolidating such various items of everyday use without sacrificing aesthetic features, and generally includes a flexible main compartment for the storage of larger items, a rigid insulated compartment for the storage of perishable items, and a rigid non-insulated compartment for the storage of smaller items, each with separate access. The rigid insulated and non-insulated compartments comprise the base of the bag, and function to both provide support for the flexible main compartment and prevent crush damage to the contents within each lower compartment.

8 Claims, 10 Drawing Sheets

(56) References Cited

U.S. PATENT DOCUMENTS

| | | | | | |
|---|---|---|---|---|---|
| 2,533,850 | A * | 12/1950 | Syracuse | A45C 3/00 | 150/112 |
| 2,801,666 | A * | 8/1957 | Steele | A45C 11/20 | 150/113 |
| 4,648,512 | A * | 3/1987 | Tarozzi | A45C 11/20 | 206/541 |
| 4,773,515 | A * | 9/1988 | Kotkins, Jr. | A45C 7/0068 | 190/103 |
| 5,005,679 | A * | 4/1991 | Hjelle | A45C 3/00 | 150/106 |
| 5,526,907 | A * | 6/1996 | Trawick | A45C 3/00 | 190/111 |
| 5,816,433 | A * | 10/1998 | Higgins | A45C 11/20 | 220/534 |
| 2005/0173034 | A1* | 8/2005 | Antrobus | A45C 5/065 | 150/104 |
| 2009/0294237 | A1* | 12/2009 | Sisitsky | A45C 1/024 | 190/103 |
| 2012/0103480 | A1* | 5/2012 | Veleno | A45C 3/001 | 150/106 |

* cited by examiner

CARRY-ALL BAG WITH FIXED INSULATED AND NON-INSULATED COMPARTMENTS

PRIORITY NOTICE

The present application is a non-provisional utility application and makes a claim of priority under 35 U.S.C. § 119(e) to prior provisional application 62/480,034 filed in the United States Patent and Trademark Office on Mar. 31, 2017.

CROSS REFERENCE TO RELATED PATENT APPLICATIONS

The present application makes no reference to any other related filed patent applications.

STATEMENT REGARDING FEDERAL SPONSORSHIP

No part of this invention was a result of any federally sponsored research.

TECHNICAL FIELD OF THE INVENTION

The present invention relates in general to utility bags, and more specifically to soft-sided carry-all bags containing fixed insulated and non-insulated compartments for extensive storage of such various items needed for everyday use including, among other things, food, footwear, laptop computers, cellular phones, books and notebooks, writing or eating utensils, water and drinks bottles, eyeglasses, coins, wallets, credit cards, cosmetics, toiletries, and clothing.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Individuals who work or attend school are often confronted with the dilemma of narrowing down what necessary items to carry with them for the full day. This dilemma frequently results in the individual user carrying multiple bags to satisfy such a need, which causes the inconvenience of cumbersome commutes or limitations on items carried caused by the excessive baggage. The present invention is directed to a soft-sided carry-all bag containing fixed insulated and non-insulated compartments for extensive storage of various items needed for everyday use, meant to provide the individual with a means for consolidating such various items of everyday use without sacrificing aesthetic features.

It is known to have 2-in-1 handbags with an outer bag housing providing a foundation handbag and an insulated secondary inner handbag with an adjustable compartment system to create separate compartments for storage and organization of items such as wallets, cosmetics, baby items, clothing, shoes, toiletries, and/or food within the handbag system. Such a design can facilitate the carrying of various items needed for everyday use in the various compartments, though the expanded use of the insulated inner adjustable compartment infringes on the usable space of the uninsulated outer nonadjustable compartment. Also, such a design does not permit access to the inner container without disturbing the contents of the inner container or the outer container. Such handbags are commonly termed "Utility Handbags," "Insulated Bags," or "Insulated Totes."

It is known to have a carry-all bag having a single compartment with internal separators for a drinks bottle and a microwaveable dish. The main compartment may have additional compartments for magazines, a mobile phone, eyeglasses, coins, or an umbrella. Such a design can facilitate the carrying of various items needed for everyday use in the various compartments, though the absence of separate, closed compartments may allow such items to fall from their locations if the bag were to fall on its side, and the lack of a separate insulated compartment fails to provide for reliable temperature retention of the food container. Also, such a design does not permit access to the various compartments without simultaneously accessing the main compartment. Such handbags are commonly termed "Carry-All Bags," or "Carry All Totes."

It is known to have a utility bag for carrying small and minute items and larger items such as medium-sized tools and the like from place to place in safety. The bag may have a generally rectangular first compartment which has an opening therein and contains at least one removable tray and a plurality of external and internal compartments for additional storage. Such a design can facilitate the carrying of various tools and hardware items and permit access to smaller items in the removable tray without disturbing the contents of the remaining compartments, though the design may fail to retain its shape when the removable tray is removed from its compartment and the design does not provide an insulated component for reliable temperature retention of food or a food container. Also, such a design may allow the removable tray to become misplaced or broken, thus negating the benefit of the utility bag's removable tray compartment. Such utility bags are commonly termed "Tool Bags with Pull-Out Tray" or "Fabric Tool Boxes."

It is known to have a tote bag for carrying athletic clothing and equipment fitted with a flexible cooling chamber, the cooling chamber being comprised of a cooling compartment secured to an uninsulated portion of the tote bag. The cooling chamber may be equipped with means for removing the insulating liner from the housing member and also for detachably removing the housing member from the uninsulated portions of the tote bag. Such a design can facilitate the carrying of various items needed for athletic use, though the flexible cooling chamber does not provide crush protection of food or food containers contained within and such a design may allow the removable cooling chamber to become misplaced, thus negating the benefit of the tote bag's removable cooling chamber. Finally, such a design does not lend itself generally to the aesthetic of a school or work environment. Such tote bags are commonly termed "Cooler Gym Bags" or "Cooler Duffle Bags."

It is known to have a backpack having enclosed compartments suitable for storing and transporting articles requiring thermally insulated and waterproof protection. The backpack being comprised of two sections, one of which is thermally insulated for carrying articles that need to be kept cold or warm and sandwiched between an inner and an outer flexible material. Such a design can facilitate the carrying of various items needing reliable temperature retention of food or a food container, though the flexible insulated compartment does not provide crush protection of food or food containers contained within. Such backpacks are commonly termed "Insulated Backpacks."

It is known to have a bag having enclosed compartments suitable for storing and transporting various items needed for everyday use, having a single flap and a single shoulder strap or similar carrying method. Such a design can facilitate the carrying of various items needed for everyday use, though does not provide an insulated component for reliable temperature retention of food or a food container and the flexible compartments do not provide crush protection of food or food containers contained within. Such bags are commonly termed "Messenger Bags."

There is a need in the art for a soft-sided carry-all bag containing fixed insulated and non-insulated compartments for extensive storage of various items needed for everyday use. Such a bag should permit access to the various compartments without disturbing the contents of the remaining compartments, while also preventing infringement of any one compartment into the space of another. The bag should also prevent the displacement of items from their containers within each compartment, and the fixed insulated and non-insulated compartments should retain their shape when empty. The fixed insulated and non-insulated compartments should provide adequate crush protection for the contents therein, and the fixed insulated compartment should provide reliable temperature retention of food or a food container. Finally, the various compartments should remain attached to the carry-all bag so that no individual component can be misplaced or broken, thus negating the benefit of the bag's design use.

It is to these ends that the present invention has been developed.

BRIEF SUMMARY OF THE INVENTION

To minimize the limitations in the prior art, and to minimize other limitations that will be apparent upon reading and understanding the present specification, the present invention describes a soft-sided carry-all bag containing fixed insulated and non-insulated compartments for extensive storage of such various items needed for everyday use including, among other things, food, footwear, laptop computers, cellular phones, books and notebooks, writing or eating utensils, water and drinks bottles, eyeglasses, coins, wallets, credit cards, cosmetics, toiletries, and clothing.

It is an objective of the present invention to provide a soft-sided carry-all bag containing fixed insulated and non-insulated compartments with a flexible, top-opening main compartment for the general storage of large or small items, and containing additional pockets or slots for the specific storage of various items needed for everyday use such as laptop computers, cellular phones, books and notebooks, writing or eating utensils, water and drinks bottles, eyeglasses, coins, wallets, credit cards, cosmetics, toiletries, and clothing.

It is another objective of the present invention to provide a soft-sided carry-all bag containing fixed insulated and non-insulated compartments with a side-opening, rigid, and insulated compartment partially comprising the base of the bag for the temperature-maintained storage of perishable food items.

It is another objective of the present invention to provide a soft-sided carry-all bag containing fixed insulated and non-insulated compartments with a side-opening, rigid, and non-insulated compartment partially comprising the base of the bag for the protected storage of small, breakable items.

It is another objective of the present invention to provide a soft-sided carry-all bag containing fixed insulated and non-insulated compartments with a front pocket for the general storage of large flat items or small items of any shape.

It is another objective of the present invention to provide a soft-sided carry-all bag containing fixed insulated and non-insulated compartments that may have attached carry handles to provide for ease of transport by the individual user.

It is another objective of the present invention to provide a soft-sided carry-all bag containing fixed insulated and non-insulated compartments that may have attached shoulder straps to provide for ease of transport by the individual user.

It is another objective of the present invention to provide a soft-sided carry-all bag containing fixed insulated and non-insulated compartments that may have a detachable shoulder strap to provide for ease of transport by the individual user.

It is another objective of the present invention to provide a soft-sided carry-all bag containing fixed insulated and non-insulated compartments with various means of closure, such as zippers or locks, by which the various compartments or pockets may be sealed.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

FIG. 8 shows a logo tag 650.

DETAILED DESCRIPTION OF THE INVENTION

Certain terminology is used in the following description for reference only and is not limiting. The words "front," "rear," "anterior," "posterior," "lateral," "medial," "upper," "lower," "outer," "inner," and "interior" refer to directions toward and away from, respectively, the geometric center of the invention, and designated parts thereof, in accordance with the present disclosure. Unless specifically set forth herein, the terms "a," "an," and "the" are not limited to one element, but instead should be read as meaning "at least one." The terminology includes the words noted above, derivatives thereof, and words of similar import.

Figure 1:
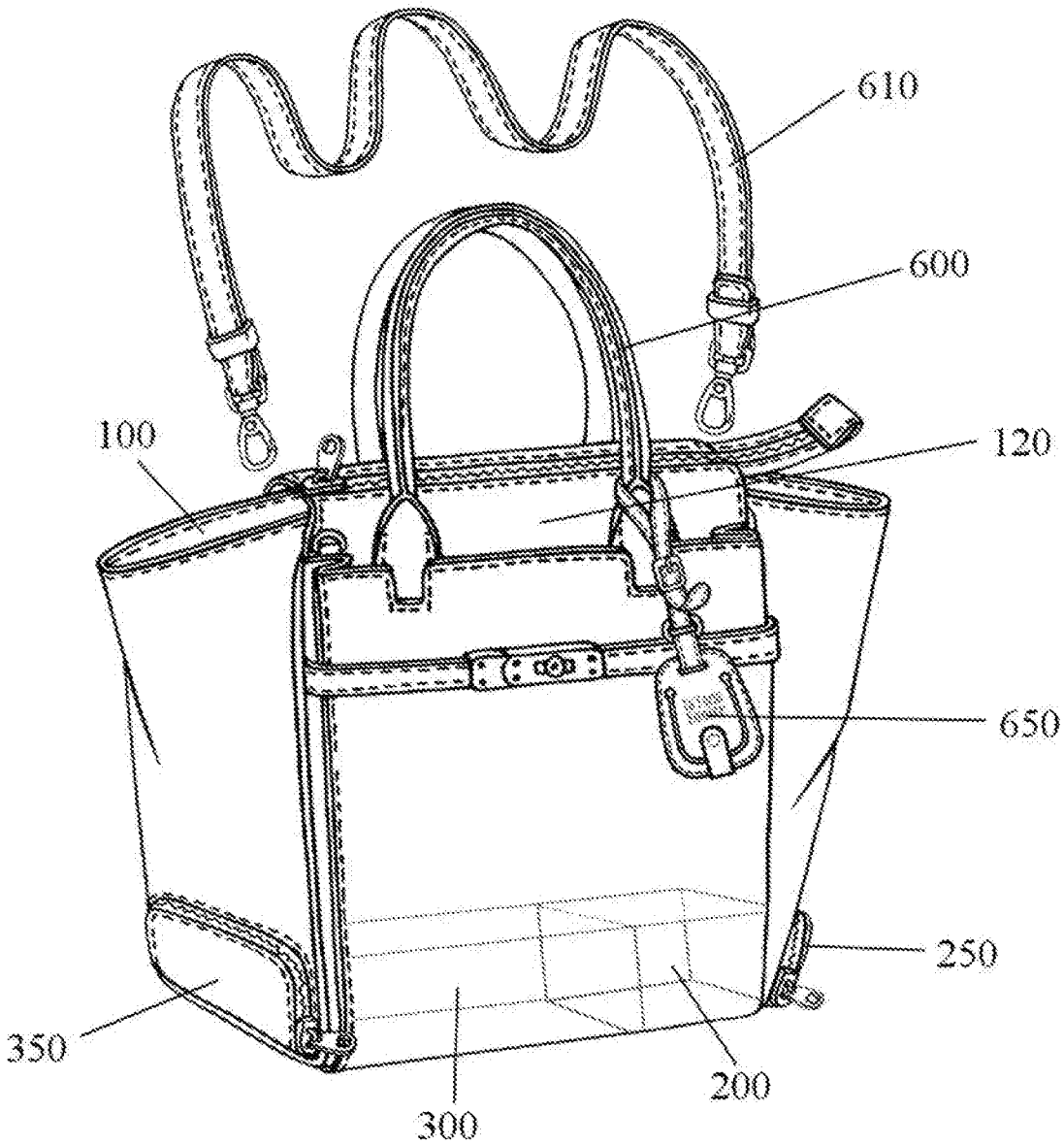
FIG. 1 shows an overall frontal view of Embodiment 1 001 of the present invention noting a flexible main body 100, front flap 120, insulated compartment flap 250, and non-insulated compartment flap 350. The figure also shows the relative positions of rigid insulated compartment 200 and rigid non-insulated compartment 300, as well as a plurality of fixed carry handles 600. Also shown are a plurality of accessories for customizing the invention, including a detachable shoulder strap 610 and a logo tag 650.
Figure 2:
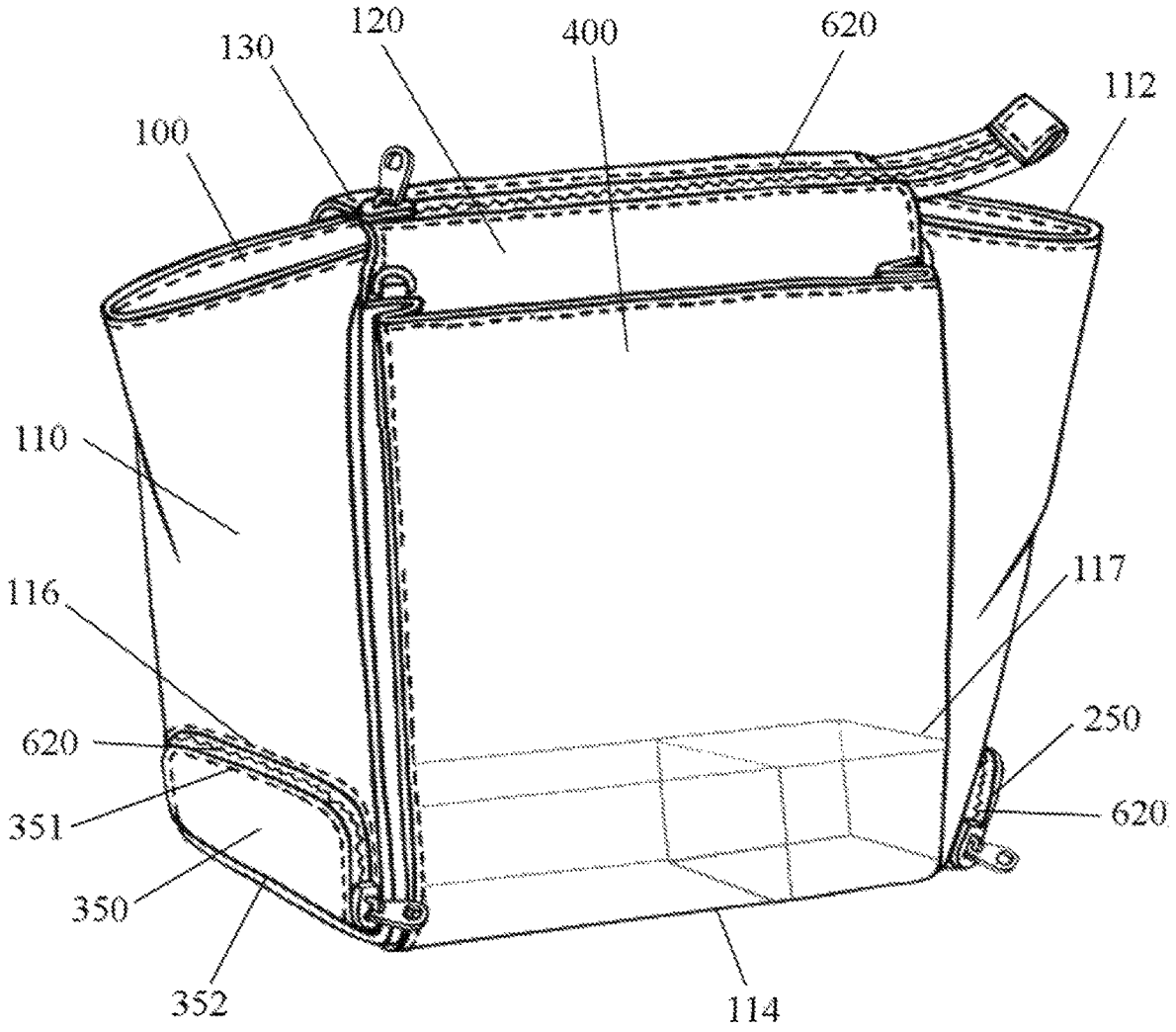
FIG. 2 shows an overall frontal view of Embodiment 1 001 of the present invention noting a flexible main body 100, front flap 120, front pocket 400, insulated compartment flap 250, and non-insulated compartment flap 350. The flexible main body 100 comprises an outer surface 110, an upper edge 112, and a lower edge 113. The figure also shows the relative positions of rigid insulated compartment 200 and rigid non-insulated compartment 300. Also shown are a plurality of zippers 620, used for closing a plurality of compartments comprising the embodiment.
Figure 3:
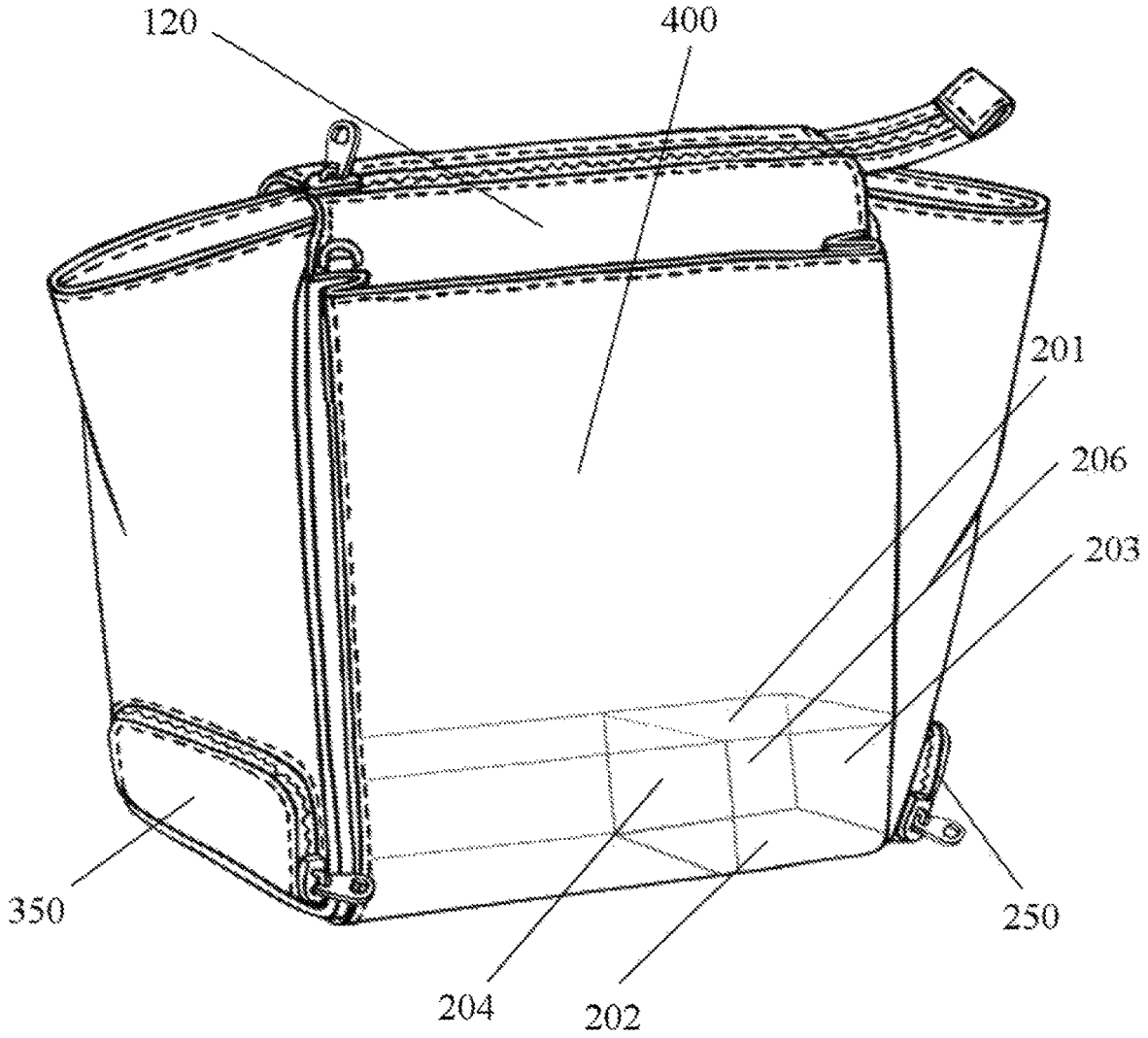
FIG. 3 shows an overall frontal view of Embodiment 1 001 of the present invention noting a front flap 120, front pocket 400, insulated compartment flap 250, and non-insulated compartment flap 350. Also shown are a plurality of surfaces comprising a rigid insulated compartment 200, notably an insulated upper surface 201, an insulated lower surface 202, an insulated lateral surface 203, an insulated medial surface 204, and an insulated posterior surface 206.
Figure 4:
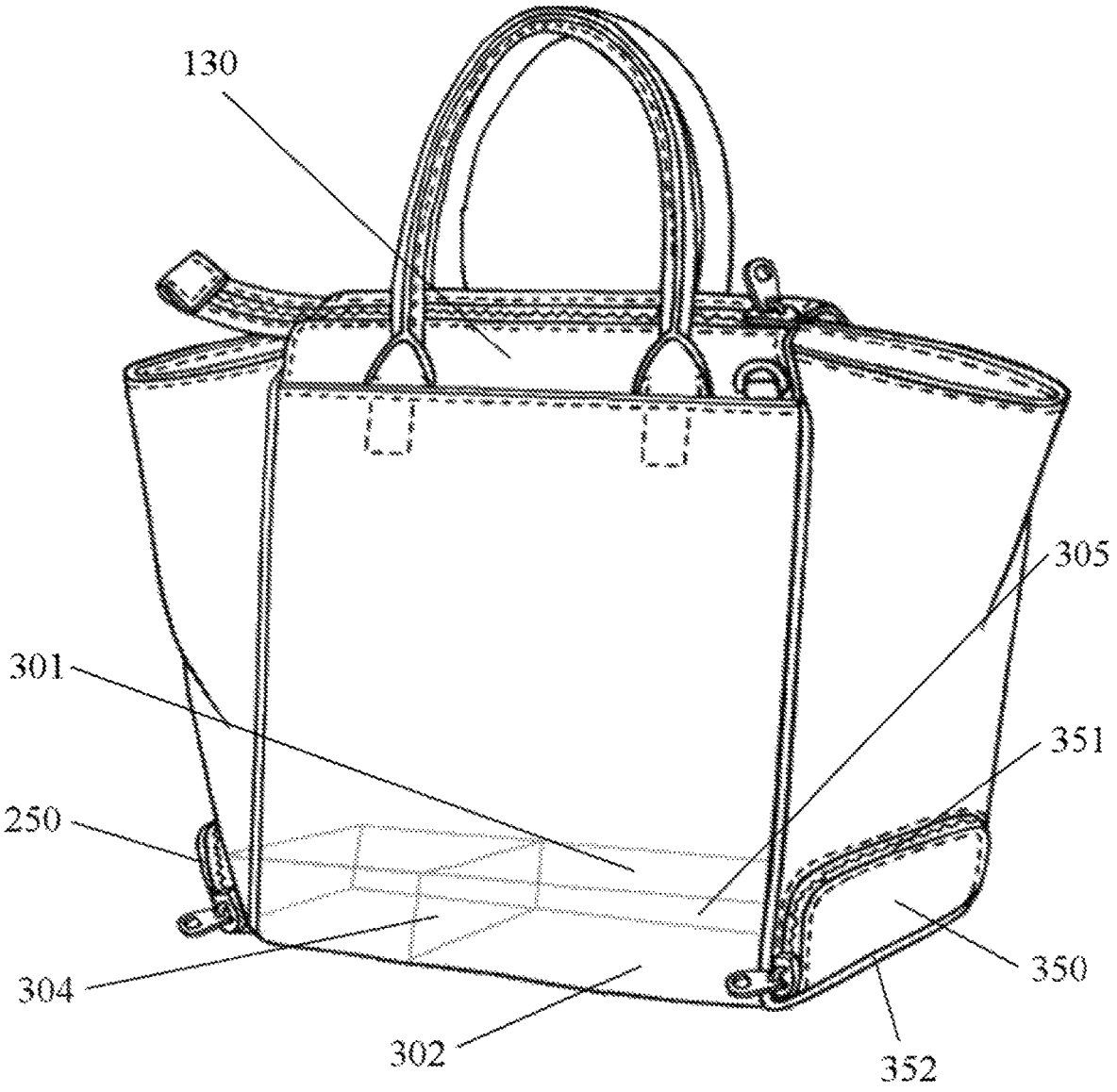
FIG. 4 shows an overall rear view of Embodiment 1 001 of the present invention noting a rear flap 130, insulated compartment flap 250, and non-insulated compartment flap 350. The non-insulated compartment flap 350 comprises a non-insulated upper edge 351 and a non-insulated lower edge 352. Also shown are a plurality of surfaces comprising a rigid non-insulated compartment 300, notably a non-insulated upper surface 301, a non-insulated lower surface 302, a non-insulated medial surface 304, and a non-insulated anterior surface 305.
Figure 5:
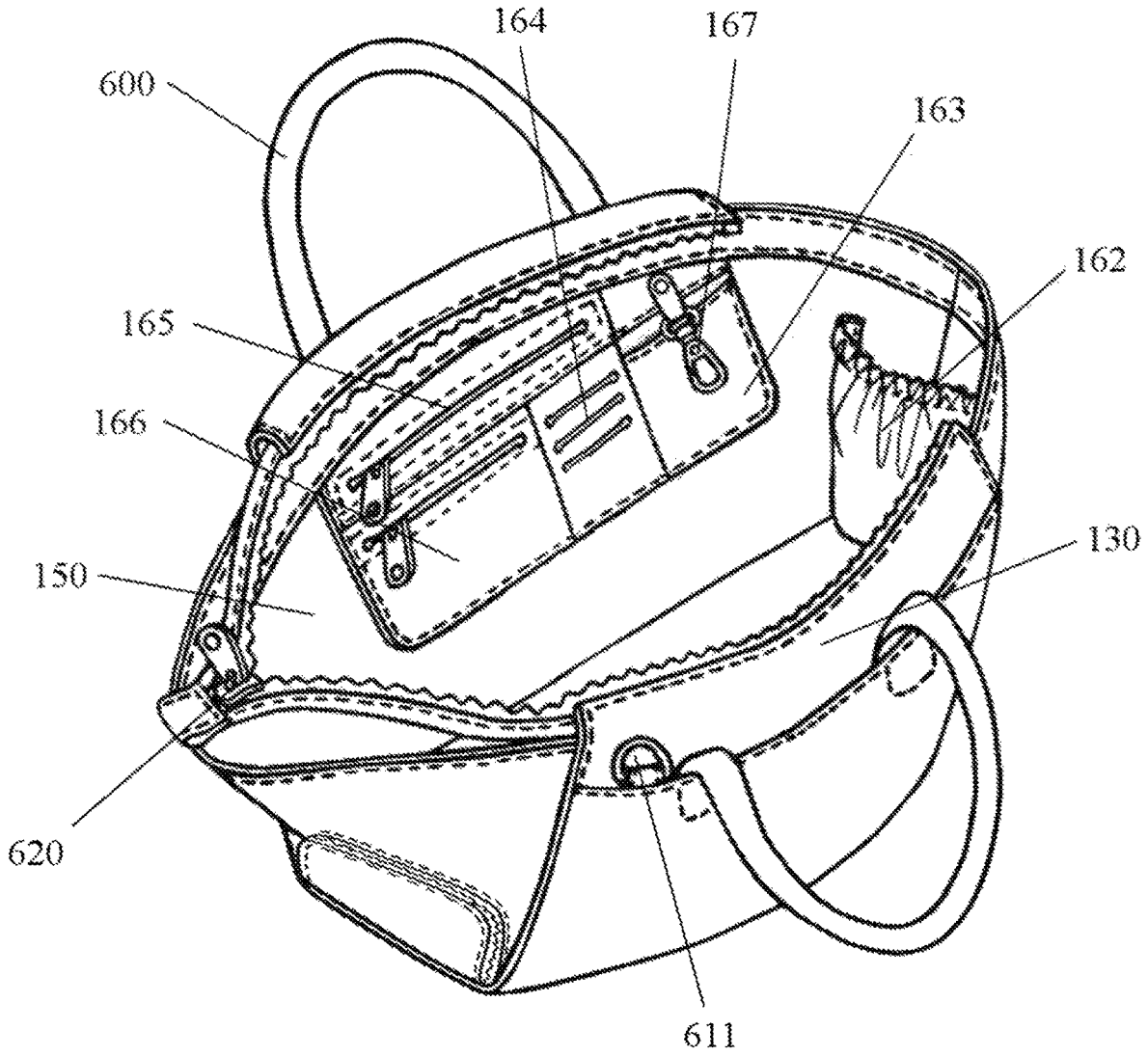
FIG. 5 shows a frontal interior view of Embodiment 1 001 of the present invention noting a rear flap 130 and a plurality of fixed carry handles 600. The figure also shows drinks bottle pocket 162, phone pocket 163, credit card slips 164, large pocket 165, small pocket 166, and keys clip 167. Also shown are a plurality of accessories for customizing the invention, including a shoulder strap ring 611 and a zipper 620.
Figure 6:
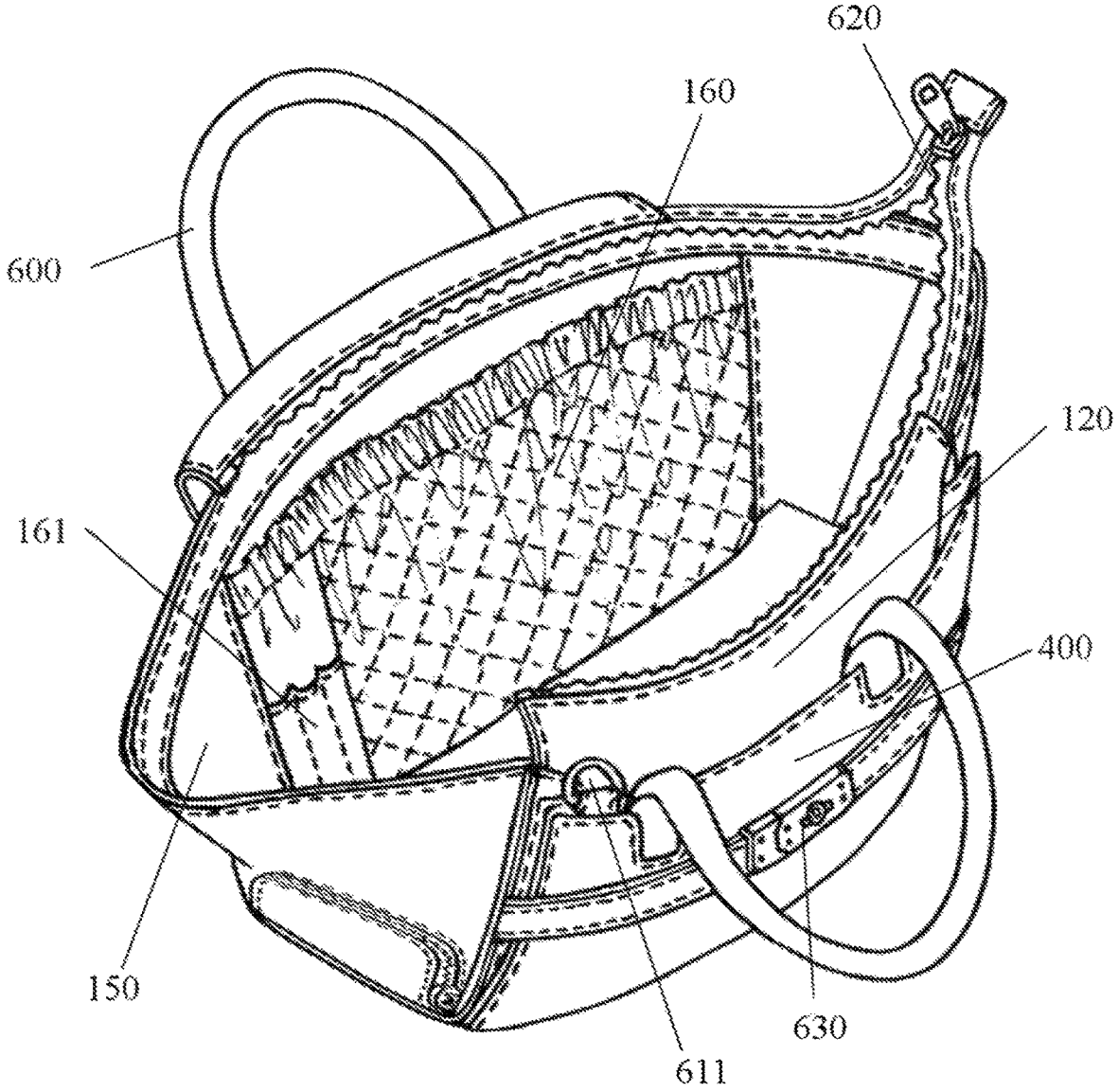
FIG. 6 shows a rearward interior view of Embodiment 1 001 of the present invention noting front flap 120, front pocket 400, and a plurality of fixed carry handles 600. The figure also shows an inner surface 151 of a main compartment interior lining 150, a laptop pocket 160, and a plurality of pen pockets 161. Also shown are a plurality of accessories for customizing the invention, including a shoulder strap ring 611, a zipper 620, and a lock 630.
Figure 7:
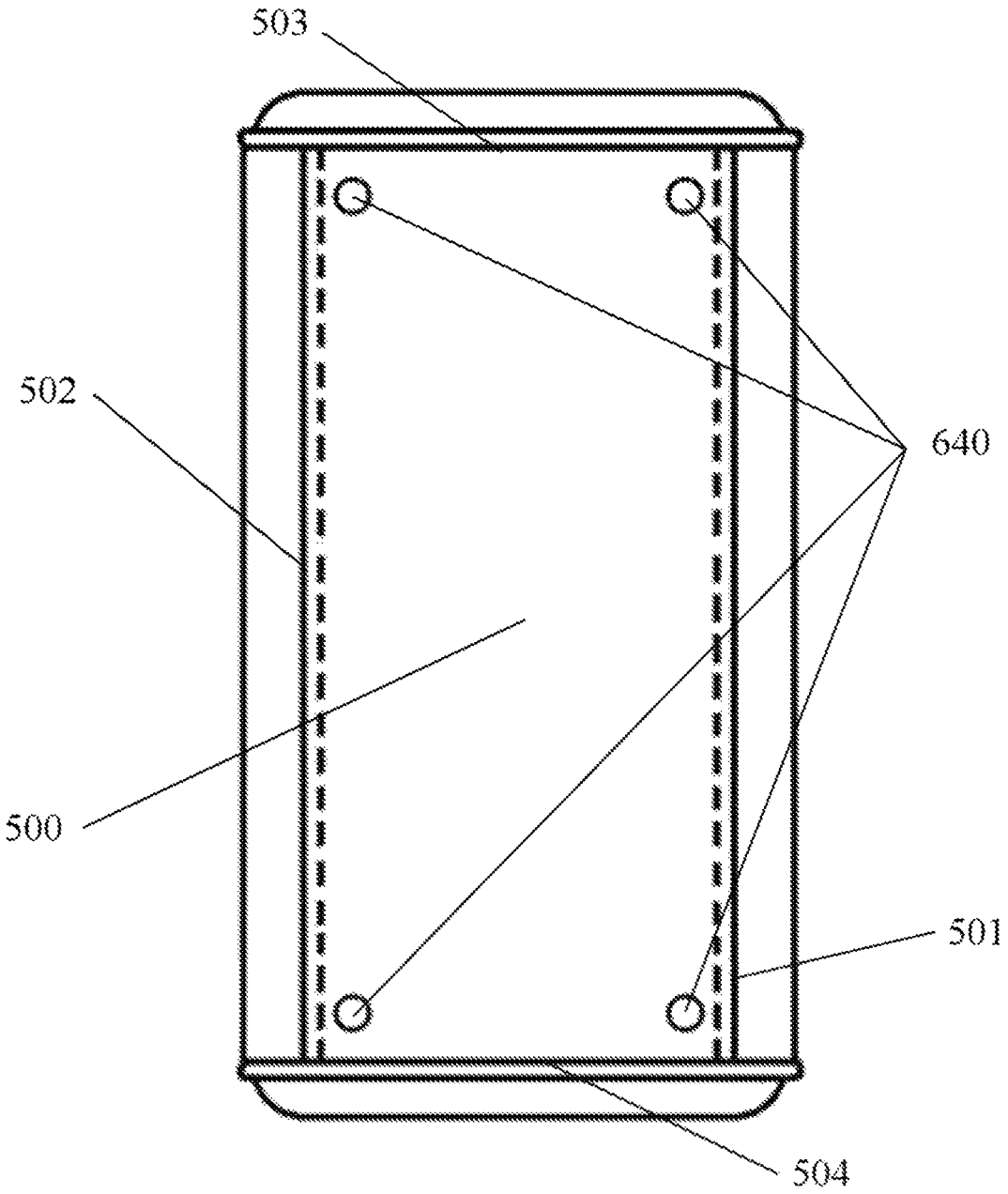
FIG. 7 shows an overall bottom view of Embodiment 1 001 of the present invention noting a base 500 and metal feet 640. The base 500 comprises a front edge 501, back edge 502, first side 503, and second side 504.
Figure 8:
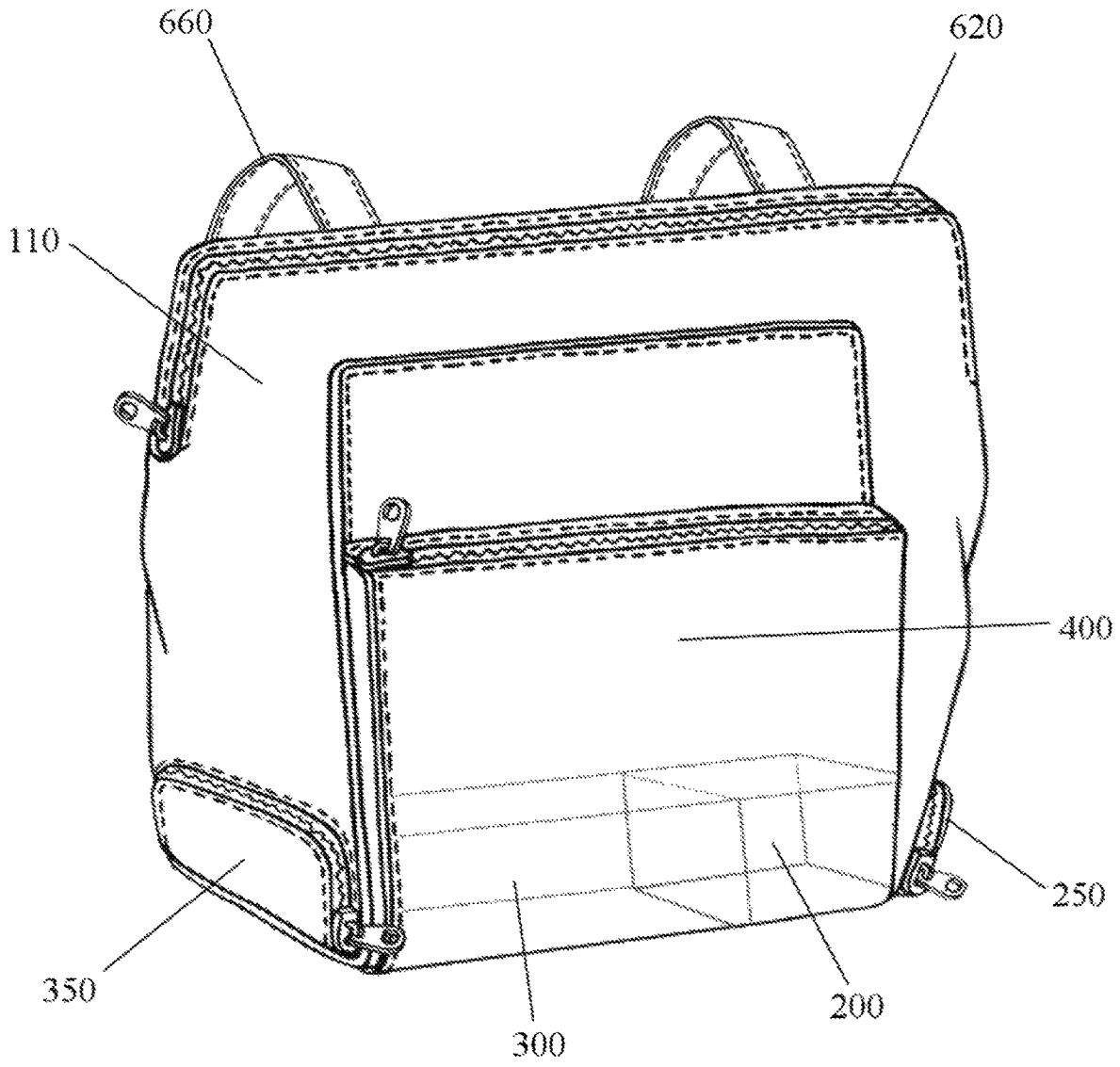
FIG. 8 shows an overall frontal view of Embodiment 2 002 of the present invention noting a flexible main body outer surface 110, front pocket 400, insulated compartment flap 250, and non-insulated compartment flap 350. The figure also shows the relative positions of rigid insulated compartment 200 and rigid non-insulated compartment 300. Also shown are a plurality of zippers 620, used for closing a plurality of compartments comprising the embodiment, and a plurality of attached shoulder straps 660.
Figure 9:
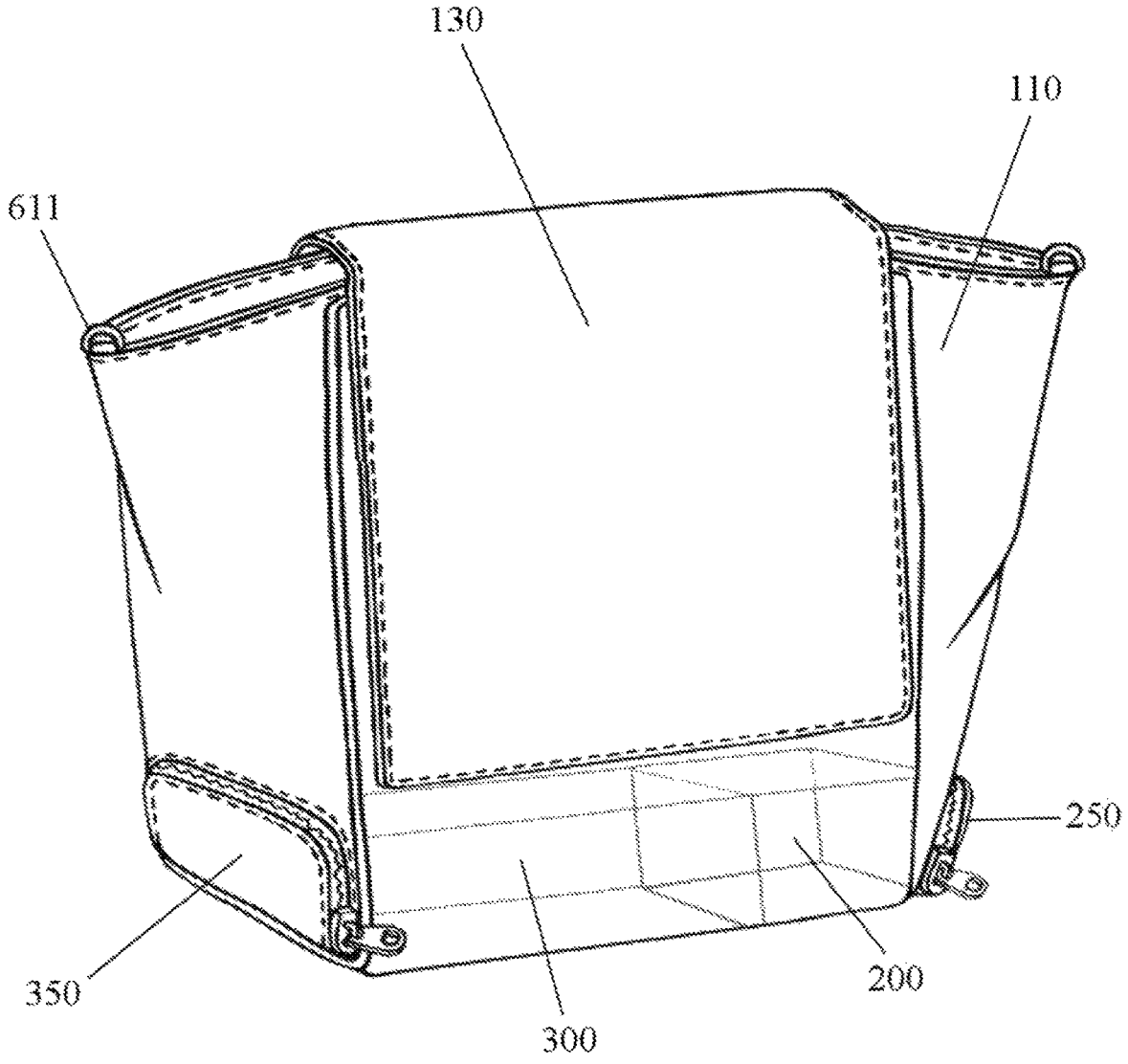
FIG. 9 shows an overall frontal view of Embodiment 3 003 of the present invention noting a flexible main body outer surface 110, rear flap 130, insulated compartment flap 250, and non-insulated compartment flap 350. The figure also shows the relative positions of rigid insulated compartment 200 and rigid non-insulated compartment 300. Also shown are a plurality of shoulder strap rings 611.
Figure 10:
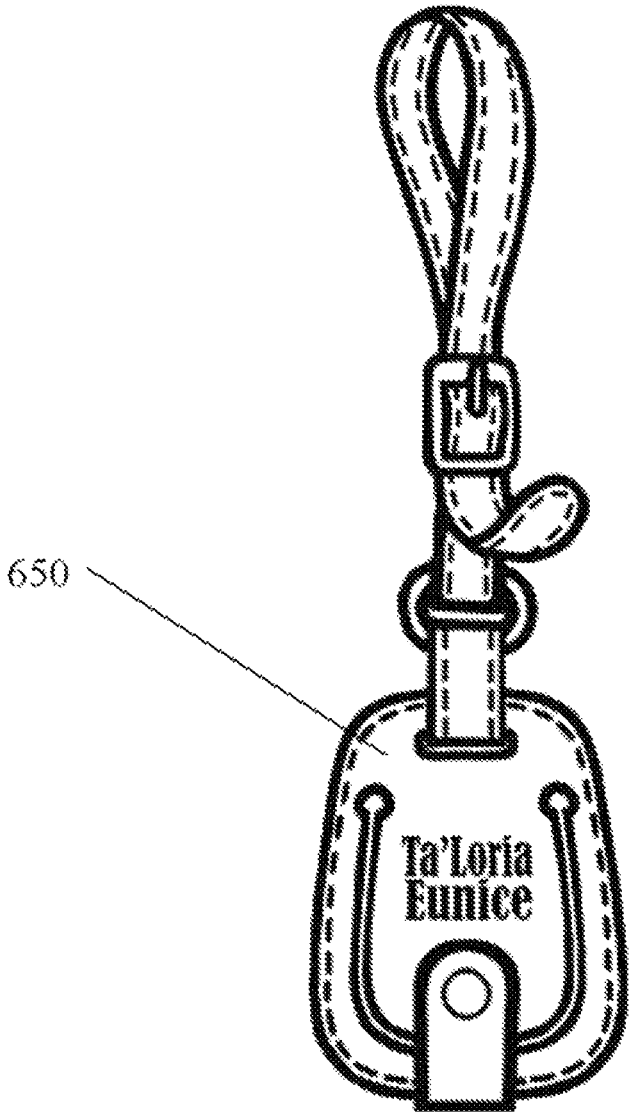

Referring to the drawings included herewith, wherein like numerals indicate like elements throughout, FIGS. 1-3 illustrate a soft-sided carry-all bag containing fixed insulated and non-insulated compartments from a frontal perspective, and FIG. 4 illustrates a soft-sided carry-all bag containing fixed insulated and non-insulated compartments from a rearward perspective. FIGS. 5 and 6 illustrate a plurality of the various accessories that may be added to the interior of a flexible main compartment to provide additional functionality. FIG. 7 illustrates a base of a soft-sided carry-all handbag containing fixed insulated and non-insulated compartments, as seen from below. FIG. 8 illustrates a second embodiment of a soft-sided carry-all bag containing fixed insulated and non-insulated compartments from a frontal perspective, and FIG. 9 illustrates a third embodiment of a soft-sided carry-all bag containing fixed insulated and non-insulated compartments from a frontal perspective. FIG. 10 illustrates a logo tag which may be added to a soft-sided carry-all bag containing fixed insulated and non-insulated compartments as a further accessory.

The various embodiments of the invention have advantageous features not present in conventional carry-all bags or utility bags. The soft-sided carry-all bag containing fixed insulated and non-insulated compartments disclosed herein can provide an individual with a means for consolidating various items of everyday use without sacrificing aesthetic features, and generally includes a flexible main compartment for the storage of larger items, a rigid insulated compartment for the protected storage of perishable items, and a rigid non-insulated compartment for the protected storage of smaller items, each with separate access. The rigid insulated and non-insulated compartments comprise the base of the bag, and function to both provide support for the flexible main compartment and prevent crush damage to the contents within each lower compartment. Additionally, the flexible main compartment may comprise additional pockets or slots for the specific storage of various items needed for everyday use such as laptop computers, cellular phones, books and notebooks, writing or eating utensils, water and drinks bottles, eyeglasses, coins, wallets, credit cards, cosmetics, toiletries, and clothing.

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention.

In FIG. 1 a soft-sided carry-all bag containing a fixed insulated compartment 200 and a fixed non-insulated compartment 300 is illustrated, in accordance with an Embodiment 1 001 of the present invention, in an orientation suitable for carrying by a user. The figure illustrates a flexible main body 100 closed by a zipper 620, an insulated compartment flap 250 closed by a zipper 620, and a non-insulated compartment flap 350 closed by a zipper 620. The figure further illustrates a front pocket 400 closed by a lock 630. Also shown in the figure are a plurality of optional accessories, including a plurality of fixed carry handles 600, a detachable shoulder strap 610, a front flap 120, a rear flap 130, and a logo tag 650.

In FIG. 2 a soft-sided carry-all bag containing a fixed insulated compartment 200 and a fixed non-insulated compartment 300 is illustrated, in accordance with an Embodiment 1 001 of the present invention. The figure illustrates a flexible main body 100 comprising a variably-shaped enclosure having an outer surface 110, an upper edge 112 forming a generally circular opening, and a lower edge 113 forming a generally rectangular shape. The lower edge 113 comprises a lower front edge 114, a lower rear edge 115, a lower first side 116, and a lower second side 117, and the lower front edge 114 may be attached to a front edge 501 of a base 500 and the lower rear edge 115 may be attached to a rear edge 502 of a base 500 so as to form the generally rectangular shape of the lower edge 113. The lower first side 116 of the lower edge 113 may be attached by a temporary means, such as a zipper 620, to a non-insulated upper side 351 of a non-insulated compartment flap 350 and the lower second side 117 of the lower edge 113 may be attached by a temporary means, such as a zipper 620, to an insulated upper side 251 of an insulated compartment flap 250. The upper edge 112 of the flexible main body 100 remains unattached.

FIG. 2 further illustrates a non-insulated compartment flap 350 having a non-insulated upper side 351 and a non-insulated lower side 352. The non-insulated upper side 351 may be attached by temporary means, such as a zipper 620, to a lower first side 116 of the lower edge 113 of the flexible main body 100, and the non-insulated lower side 352 may be attached to a first side 503 of a base 500 such that the non-insulated compartment flap 350 may hinge open when the means attaching the non-insulated upper side 351 to the lower first side 116 are separated. An insulated compartment flap 250 comprises an insulated upper side 251 and an insulated lower side 252. The insulated upper side 251 may be attached by temporary means, such as a zipper 620, to a lower second side 117 of the lower edge 113 of the flexible main body 100, and the insulated lower side 252 may be attached to a second side 504 of the base 500 such that the insulated compartment flap 250 may hinge open when the means attaching the insulated upper side 251 to the lower second side 117 are separated.

FIG. 2 further illustrates a front pocket 400 comprising an upper edge 401, a lower edge 402, a first side 403, and a second side 404. The lower edge 402 of the front pocket 400 may be attached to a front edge 501 of a base 500, the upper edge 401 of the front pocket 400 may be unattached or may be attached by temporary means, such as a zipper 620, to an outer surface 110 of a flexible main body 100, and the first side 403 of the front pocket 400 may be attached to an outer surface 110 of a flexible main body 100 and the second side 404 of the front pocket 400 may be attached to an outer surface 110 of a flexible main body 100 such that a top-opening pocket is created.

FIG. 2 further illustrates a front flap 120 comprising an upper edge 121, a lower edge 122, a first side 123, and a second side 124. The lower edge 122 of the front flap 120 may be attached to a front edge 501 of a base 500, the upper edge 121 of the front flap 120 may be unattached or may be attached by temporary means, such as a zipper 620, to an upper edge 131 of a rear flap 130, and the first side 123 of the front flap 120 may be attached to an outer surface 110 of a flexible main body 100 and the second side 124 of the front flap 120 may be attached to an outer surface 110 of a flexible main body 100 such that a flap attached to the front of the bag and extending over the upper edge 112 of the flexible main body 100 is created.

FIG. 2 further illustrates a rear flap 130 comprising an upper edge 131, the lower edge 132, a first side 133, and a second side 134. The lower edge 132 of the rear flap 130 may be attached to a rear edge 502 of a base 500, the upper edge 131 of the rear flap 130 may be unattached or may be attached by temporary means, such as a zipper 620, to an upper edge 121 of a front flap 120, and the first side 133 of the rear flap 130 may be attached to an outer surface 110 of a flexible main body 100 and the second side 134 of the rear flap 130 may be attached to an outer surface 110 of a flexible main body 100 such that a flap attached to the rear of the bag and extending over the upper edge 112 of the flexible main body 100 is created.

In FIG. 3 a soft-sided carry-all bag containing a fixed insulated compartment 200 and a fixed non-insulated compartment 300 is illustrated, in accordance with an Embodiment 1 001 of the present invention. The figure illustrates a rigid fixed insulated compartment 200 comprising an insulated upper surface 201, an insulated lower surface 202, an insulated lateral surface 203, an insulated medial surface 204, an insulated anterior surface 205, and an insulated posterior surface 206. The insulated lower surface 202 may comprise a portion of a base 500 or may be attached to an upper surface of a portion of a base 500. The insulated lateral surface 203 may be attached to an insulated compartment flap 250, such that the insulated lateral surface 203 hinges open in combination with the insulated compartment flap 250. The insulated medial surface 204 may be attached to a non-insulated medial surface 304 of a rigid non-insulated compartment 300. The insulated anterior surface 205 and insulated posterior surface 206 may be attached to an inner surface 111 of a flexible main body 100.

The plurality of insulated surfaces may be rigid such that they give structure and support to a lower edge 113 of the flexible main body 100 and prevent crush damage to the contents within the fixed insulated compartment 200, the insulated lower surface 202 combined with a non-insulated lower surface 302 of a fixed non-insulated compartment 300 may comprise the entirety of an upper surface of a base 500, and the insulated upper surface 201 combined with a non-insulated upper surface 301 of a fixed non-insulated compartment 300 may comprise the entirety of a bottom of a main compartment within the flexible main body 100.

The plurality of insulated surfaces may be lined with an insulative material such that they provide reliable temperature retention of food or a food container contain within. The insulative material may be substantially constructed of any suitable insulation or combination of insulations, but typically is constructed of a resilient insulation or combination of insulations such that the combination provides reliable temperature retention of food or a food container contained within. As an example, and without limiting the scope of the present invention, various exemplary embodiments of the insulative material may be substantially constructed of polystyrene, polyethylene, polyurethane, cellulose, or combinations thereof. The thickness of the material used in each component may vary as desired.

In FIG. 4 a soft-sided carry-all bag containing a fixed insulated compartment 200 and a fixed non-insulated compartment 300 is illustrated, in accordance with an Embodiment 1 001 of the present invention. The figure illustrates a rigid fixed non-insulated compartment 300 comprising a non-insulated upper surface 301, a non-insulated lower surface 302, a non-insulated lateral surface 303, a non-insulated medial surface 304, a non-insulated anterior surface 305, and a non-insulated posterior surface 306. The non-insulated lower surface 302 may comprise a portion of a base 500 or may be attached to an upper surface of a portion of a base 500. The non-insulated lateral surface 303 may be attached to a non-insulated compartment flap 350, such that the non-insulated lateral surface 303 hinges open in combination with the non-insulated compartment flap 350. The non-insulated medial surface 304 may be attached to an insulated medial surface 204 of a rigid insulated compartment 200. The non-insulated anterior surface 305 and non-insulated posterior surface 306 may be attached to an inner surface 111 of a flexible main body 100.

The plurality of non-insulated surfaces may be rigid such that they give structure and support to a lower edge 113 of the flexible main body 100 and prevent crush damage to the contents within the fixed non-insulated compartment 300, the non-insulated lower surface 302 combined with an insulated lower surface 202 of a fixed insulated compartment 200 may comprise the entirety of an upper surface of a base 500, and the non-insulated upper surface 301 combined with an insulated upper surface 201 of a fixed insulated compartment 200 may comprise the entirety of a bottom of a main compartment within the flexible main body 100.

In FIG. 5 a soft-sided carry-all bag containing a fixed insulated compartment 200 and a fixed non-insulated compartment 300 is illustrated, in accordance with an Embodiment 1 001 of the present invention. A main compartment defined by a flexible main body 100 is shown with a main compartment interior lining 150. The figure illustrates a plurality of accessories for customizing the invention, including a drinks bottle pocket 162, a phone pocket 163, a plurality of credit card slips 164, a large pocket 165, a small pocket 166, and a keys clip 167. Also shown are a shoulder strap ring 611 for receiving a detachable shoulder strap 610 and a zipper 620 for closing a main compartment defined by a flexible main body 100.

In FIG. 6 a soft-sided carry-all bag containing a fixed insulated compartment 200 and a fixed non-insulated compartment 300 is illustrated, in accordance with an Embodiment 1 001 of the present invention. A main compartment defined by a flexible main body 100 is shown with a main compartment interior lining 150. The figure illustrates a plurality of accessories for customizing the invention, including a laptop pocket 160 and a plurality of pen pockets 161. Also shown are a shoulder strap ring 611 for receiving a detachable shoulder strap 610 and a zipper 620 for closing a main compartment defined by a flexible main body 100, and a lock 630 for closing a front pocket 400.

In FIG. 7 a base 500 of a soft-sided carry-all bag containing a fixed insulated compartment 200 and a fixed non-insulated compartment 300 is illustrated, in accordance with an Embodiment 1 001 of the present invention. The base 500 comprises a front edge 501, a rear edge 502, a first side 503, and a second side 504. The front edge 501 of the base 500 may be attached to a lower front edge 114 of a flexible main body 100 and the rear edge 502 may be attached to a lower your edge 115 of a flexible main body 100. The first side 503 may be attached to a non-insulated lower side 352 of a non-insulated compartment flap 350 and the second side 504 may be attached to an insulated lower side 252 of an insulated compartment flap 250. Also shown are a plurality of metal feet 640.

In FIG. 8 a soft-sided carry-all bag containing a fixed insulated compartment 200 and a fixed non-insulated compartment 300 is illustrated, in accordance with an Embodiment 2 002 of the present invention. The figure illustrates a carry-all bag comprising a main compartment defined by a flexible main body 100, a rigid insulated compartment 200, and a rigid non-insulated compartment 300. The figure further illustrates an Embodiment 2 002 having a front pocket 400 and a plurality of attached shoulder straps 660.

In FIG. 9 a soft-sided carry-all bag containing a fixed insulated compartment 200 and a fixed non-insulated compartment 300 is illustrated, in accordance with an Embodiment 3 003 of the present invention. The figure illustrates a carry-all bag comprising a main compartment defined by a flexible main body 100, a rigid insulated compartment 200, and a rigid non-insulated compartment 300. The figure further illustrates an Embodiment 3 003 having a rear flap 130 extending over an opening created by an upper edge 112 of a flexible main body 100 and attaching on a front of an outer surface 110 of a flexible main body 100 such that the rear flap 130 serves as a means for closing a main compartment defined by a flexible main body 100. The figure also illustrates a plurality of shoulder strap rings 611.

In FIG. 10 a logo tag 650 is illustrated.

The soft-sided carry-all bag containing a fixed insulated compartment and a fixed non-insulated compartment may be substantially constructed of any suitable fabric or combination of fabrics, but typically is constructed of a resilient fabric or combination of fabrics such that the combination is resistant to wear and damage as a result of everyday use. As an example, and without limiting the scope of the present invention, various exemplary embodiments of the soft-sided carry-all bag containing fixed insulated and non-insulated compartments may be substantially constructed of one or more materials of leather, denim, cotton, wool, nylon, polyester, silk, cashmere, acrylic, or combinations thereof. The thickness of the material used in each component may vary as desired. Additionally, one or more additional materials may be added to impart the desired amount of resiliency or elasticity, such as elastane, rubber, or latex.

The plurality of rigid components of the soft-sided carry-all bag containing a fixed insulated compartment and a fixed non-insulated compartment may be substantially constructed of any suitable solid or semi-solid materials, but typically is constructed of a resilient material or combination of materials such that the combination is resistant to compression, flexing, and crush damage as a result of everyday use. As an example, and without limiting the scope of the present invention, various exemplary embodiments of the rigid components may be substantially constructed of one or more materials of plastic, wood, fiberglass, carbon fiber, aluminum, steel, or combinations thereof. The thickness of the material used in each component may vary as desired.

Note with respect to the materials of construction, it is not desired nor intended to thereby unnecessarily limit the present invention by reason of such disclosure.

A soft-sided carry-all bag containing fixed insulated and non-insulated compartments for extensive storage of various items needed for everyday use has been described. The foregoing description of the various exemplary embodiments of the invention has been presented for the purposes of illustration and disclosure. While the invention has been described in connection with what is presently considered to be the most practical and preferred embodiments, it is to be understood that the invention is not to be limited to the disclosed embodiments, but, on the contrary, is intended to cover various modifications and equivalent arrangements included within the spirit and scope of the appended claims.

We claim:

1. A carry-all bag combination, comprising:

a main compartment;

an insulated compartment;

a non-insulated compartment; and a rigid compartment assembly;

wherein said main compartment comprises a flexible compartment;

wherein said insulated compartment comprises a rigid compartment;

wherein said non-insulated compartment comprises a rigid compartment;

wherein said rigid compartment assembly comprises said insulated compartment and said non-insulated compartment;

wherein said insulated compartment and said non-insulated compartment are affixed to one another;

wherein said rigid compartment assembly comprises a support base for said carry-all bag combination;

wherein said main compartment is affixed on top of said rigid compartment assembly;

wherein said insulated compartment comprises a top surface, a bottom surface, a front surface, a rear surface, a first lateral side, a second lateral side, and an insulating layer;

wherein said insulating layer comprises an inner surface of said insulated compartment;

wherein said first lateral side of said insulated compartment comprises a removably attached insulated opening flap;

wherein said non-insulated compartment comprises a top surface, a bottom surface, a front surface, a rear surface, a first lateral side, and a second lateral side; and wherein said first lateral side of said non-insulated compartment comprises a removably attached non-insulated opening flap.

2. The invention of claim 1, further comprising:

an outer covering layer;

wherein said outer covering layer comprises an outer surface of said carry-all bag combination.

3. The invention of claim 2, further comprising:

a plurality of outer pockets.

4. The invention of claim 2, further comprising:

a plurality of top flaps.

5. The invention of claim 2, further comprising:

a plurality of attached carry handles.

6. The invention of claim 2, further comprising:

a plurality of attached shoulder straps.

7. The invention of claim 2, further comprising:

a plurality of detachable shoulder straps.

8. The invention of claim 2, further comprising:

a plurality of means of closure.

* * * * *